United States Patent [19]

Smith

[11] 3,967,771

[45] July 6, 1976

[54] SELF-CONTAINED IMPACT TOOL

[76] Inventor: James E. Smith, 217 Meadowlook Way, Boulder, Colo. 80302

[22] Filed: Dec. 16, 1974

[21] Appl. No.: 532,792

[52] U.S. Cl. ..... 227/10

[51] Int. Cl.[2] ..... B25C 1/08

[58] Field of Search ..... 227/9, 10, 120

[56] References Cited

UNITED STATES PATENTS

| | | | |
|---|---|---|---|
| 2,898,893 | 8/1959 | Rohrer et al. | 227/10 X |
| 3,042,008 | 7/1962 | Liesse | 227/9 |
| 3,362,602 | 1/1968 | Anstett | 227/120 |
| 3,381,672 | 5/1968 | Tobias et al. | 227/10 |
| 3,850,359 | 11/1974 | Obergfell | 227/10 |

*Primary Examiner*—Granville Y. Custer, Jr.
*Attorney, Agent, or Firm*—Thomas W. O'Rourke

[57] ABSTRACT

An impact tool, and particularly a nail driver, utilizing a vaporized combustible mixture which may be ignited upon demand to drive a piston and associated ram in a cylinder to accomplish work such as driving a nail. In a particularly preferred embodiment, a portion of the driving energy is stored and utilized to recharge the device for rapid semi-automatic demand operation. The recharge energy may be stored in, for example, a spring or in a pressurized high-pressure cylinder and the fuel stored in bulk and metered during the recharge process.

6 Claims, 10 Drawing Figures

10
26
47
43
22
23
9
14
7
50
55
52
18
84
82
51
56
58
109
40
70
83
17
8
81
86
54
53
7
105
101
87
113
107
58
80
89
108
104
90
91
61
112
13
58
68
9
114
115
102
69
93
101
8
77
20
60
64
62
75
65
95
19
97
98
96

117
117
113
113
112
112
114
115
115
101
114

14
50
58

26
70
101
102
69
68
80
81
83
104
121
78
120
19
87
13
20
77
91

SELF-CONTAINED IMPACT TOOL

BACKGROUND OF THE INVENTION

1. Field of the Invention

The present invention relates generally to impact tools, and more particularly to self-contained impact tools utilizing a combustible mixture to provide the energy necessary to accomplish work, either in a single operation or semi-automatic operation.

2. Description of the Prior Art

Impact tools are per se well known and have been utilized for a great number of purposes including loosening and tightening rotary fasteners such as nuts and bolts, setting rivets, and driving nails and staples. Basically, since the tools are generally portable and, accordingly, relatively lightweight, operation is predicated upon the transfer of a great amount of energy over a very short duration to accomplish a modest amount of work. The amount of work involved is, of course, relative and may, as in the instance of driving fasteners into concrete, involve instantaneous work rates of over 100 horse power and instantaneous force loadings of several thousand pounds.

The short duration over which such loadings occur satisfy two fundamental principles. First, the overall energy requirement is relatively modest and the accelerations are very large. The latter point enables a relatively light, portable tool to be essentially unmoved by interface loadings of greater than a thousand pounds as a result of the inertia of the tool mass.

For the most part, heavy duty impact tools are operated by compressed air. Particularly in commercial and industrial settings, such relatively high-energy impact tools require a compressor and a source of compressed air. Despite the need for providing compressors, the efficiency and convenience of impact tools have prompted use on even relatively remote construction jobs by means of portable compressors.

Relatively low energy impact tools, such as lightweight staple drivers, operate on a somewhat different principle. Instead of a constant, high-energy source such as compressed air, a spring is hand compressed to store energy and, again in a short time, released to substantially instantaneously apply the accumulated energy to a ram which, in turn, drives a relatively small staple or nail. Portability is found with high energy in conjunction with the use of discrete charges such as blank cartridges or caseless explosive pellets. However, these are not suitable for high volume, rapid rate work such as is provided by compressor-driven impact tools. U.S. Pat. No. 3,162,123 is illustrative of such prior concepts.

Summarily, other than relatively recent work utilizing fly wheel energy, almost every high-energy impact tool currently used utilizes compressed air and an external substantial power supply as an energy source. In any event, external power sources are required unless a limited supply of discrete charges are employed.

SUMMARY OF THE INVENTION

The present invention, which provides a heretofore unavailable improvement over previous impact tool devices, comprises a mechanism utilizing a combustible mixture, preferably gaseous, to drive a piston and attached ram which then functions in a conventional manner to drive, rotate or otherwise perform work upon an object. The combustible mixture, which utilizes both the formation of numerous combustion molecules from a relatively small number of fuel molecules as well as the release of substantial amounts of heat energy to expand the gas, is capable of providing many repetitive operations from a relatively small source of combustible gas. For instance, it has been empirically determined that a 16-penny (3.25 inch) nail driven into semi-hard wood requires a peak loading of about 1,000 pounds and about 125 foot pounds of energy to drive. Preferably, this is accomplished by expending on the order of 75 horse power for about 3 milliseconds. Using such typical parameters, the energy in 1 pound of propane is capable of driving 40,000 nails. Thus, it will be apparent that the compact, relatively simple mechanism can be provided for convenient operation as an impact tool, and particularly as a nail driver. By combining the tool with conventional magazine feed of, for instance, nails and providing an automatic recharge or reloading system, a small container of bulk combustible gas can be employed in semi-automatic fashion to rapidly and conveniently operate in a self-contained manner.

Accordingly, an object of the present invention is to provide a new and improved self-contained impact tool which is capable of relatively high-energy operation.

Another object of the present invention is to provide a new and improved impact tool which utilizes a lightweight, high-energy combustible mixture to rapidly develop the required energy for operation.

Yet another object of the present invention is to provide a new and improved impact tool which is capable of rapid, convenient, semi-automatic operation upon demand.

Still another object of the present invention is to provide a new and improved impact tool which has a low fuel consumption characteristic for operation in areas without external power sources.

Still yet another object of the present invention is to provide a new and improved impact tool which is substantially recoil free, lightweight and capable of delivering high, instantaneous work rates.

Further objects of the present invention are to provide an impact tool and method of operation which is lightweight, simple, compact and capable of providing work loads comparable to those provided by other tools utilizing external energy power sources such as compressors.

These and other objects and features of the present invention will become apparent from the following description.

DETAILED DESCRIPTION OF THE INVENTION

Figure 1:
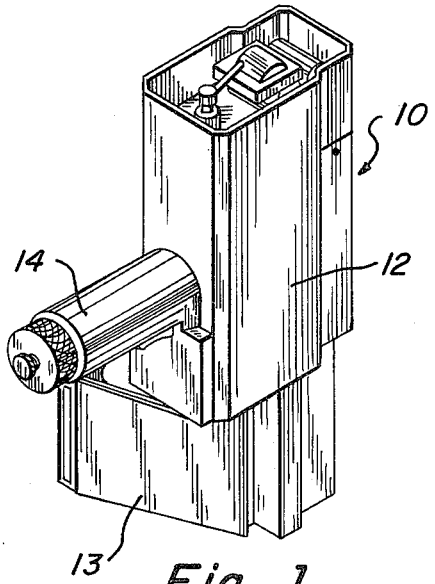
FIG. 1 is a perspective view of an impact tool according to the instant invention.

Turning now to the drawings, wherein like components are designated by like reference numerals throughout the various figures, an impact tool for driving nails utilizing the concept of the instant invention is illustrated in FIG. 1 and generally designated by the reference numeral. Impact tool includes a body portion 12, magazine 13 and handle 14, as illustrated. The details of this embodiment will be described more specifically with regard to the discussion of FIGS. 6 through 10.

Figure 2:
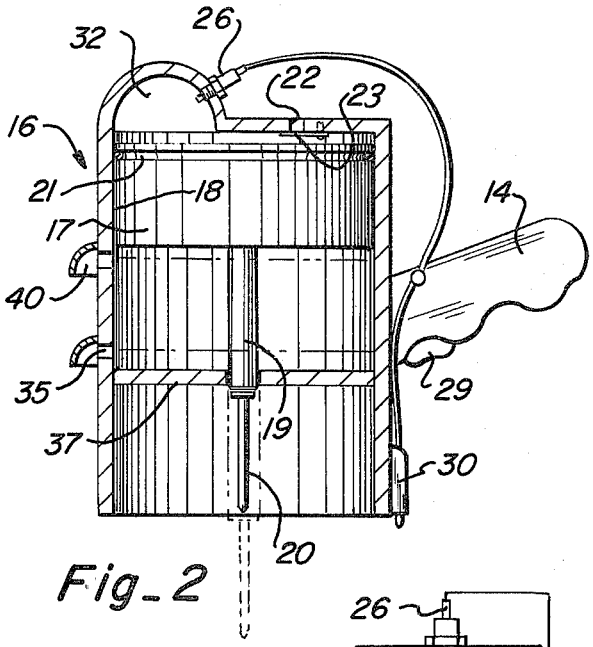
FIG. 2 is a simplified, sectioned view of an impact tool according to the instant invention in the ready configuration suitable for driving a nail.
Figure 3:
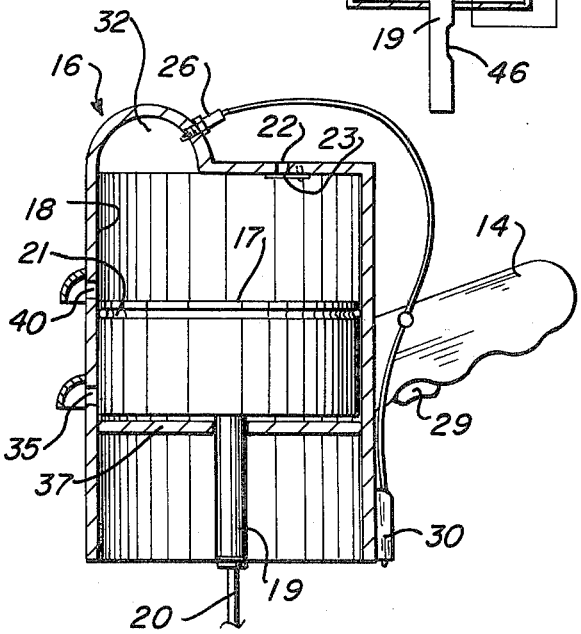
FIG. 3 is a view similar to FIG. 2 but illustrating the tool in the extended position.

A more simplified embodiment of the invention is illustrated in FIGS. 2 and 3 and generally designated by reference numeral 16. As will be described in more detail hereinafter, driver 16 is basically comprised of a piston 17 fitted within a closed-top cylinder 18. Handle 14 protrudes from cylinder 18 and is preferably hollow to house circuitry or other components. A hardened steel ram 19 extends from piston 17 and terminates in a configuration adapted to engage a nail 20. O-rings 21 are provided to seal between piston 17 and cylinder 18. Other sealing means, such as piston rings, etc., may optionally be employed.

As shown in FIG. 2, nail 20 is engaged by ram 19. A measured quantity of combustible gas, such as propane, is injected through port 22 and through a check valve which may conveniently be in the form of reed valve 23. The combustible gas is compressed, as shown in FIG. 3, by applying a downward force upon driver 16 thus forcing nail 20 to bear upon a work surface (not shown) to drive ram 19 and attached piston 17 to the position shown in FIG. 2. Port 22 is sealed by reed valve 23 during the compression stroke. Ignition device 26, which is preferably in the form of a spark plug, is then fired by means such as trigger 29 or switch 30, or a combination thereof, according to circuits as described below.

Compressed gas in combustion chamber 32 is ignited by ignition device 26 thereby producing a substantial pressure on the upper surface of piston 17 and driving piston 17 and ram 19 towards the work surface. Nail 20 is driven into the work surface by ram 19. It will be noted that the volume below piston 17 is vented to atmospheric pressure through vent 35 between wall 37 and the lower portion of piston 17. Thus, the pressure above piston 17 is not counter-balanced by pressure other than atmospheric pressure below piston 17. When nail 20 is driven into the work surface, the device is again substantially in the configuration shown in FIG. 3. The combustion gases are exhausted through exhaust port 40 which is shown in a piston-timed configuration, and the lower portion of piston 17 also through a piston-timed arrangement closes vent 35 thereby sealing a volume of air between wall 37, a small portion of cylinder wall 18 and a lower portion of piston 17. This cushions and decelerates piston 17 permitting the production of an excess of combustion energy to ensure that nail 20 is completely and securely driven while providing for the non-destructive stopping of piston 17 and dissipation of energy.

The inertia of the exhaust gases escaping through exhaust port 40 draws fresh air through port 22 thereby purging the combustion products and providing a fresh charge of air. Preferably, an air filter (not shown) is provided to entrap foreign matter.

In the simple embodiment shown in FIGS. 2 and 3, the operation is repeated by injecting another measured volume of constant pressure combustible gas through pot 22, inserting another nail 20 into contact with ram 19 and again compressing and igniting the combustible mixture.

Figure 5:
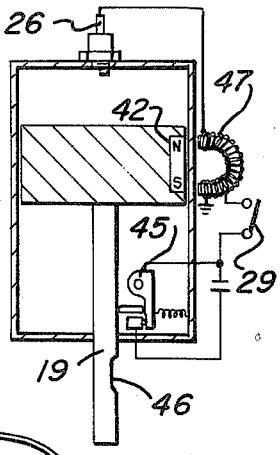
FIGS. 4 and 5 are schematic diagrams of circuits suitable for firing the device according to the instant invention.
Figure 4:
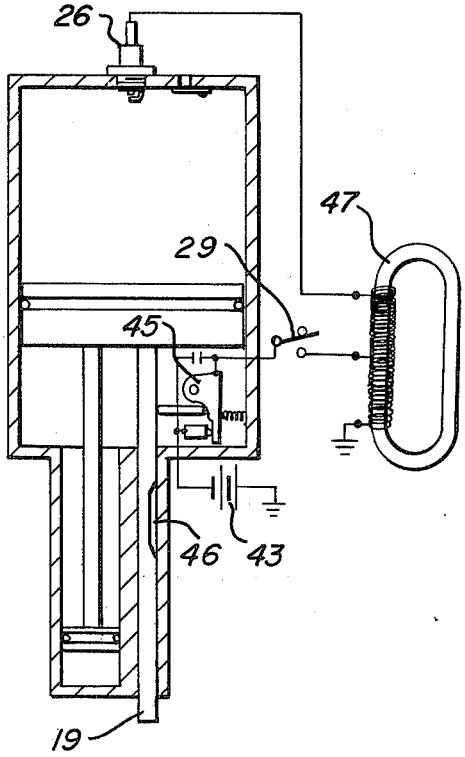

While any number of known means may be employed to fire ignition device 26, circuitry as shown in FIGS. 4 and 5 may be energized by, for instance, a battery 43 as shown in FIG. 4 or, alternatively, by a magnet 42 on piston 17 passing a coil 47 in a magneto arrangement as shown in FIG. 5. Otherwise, the embodiments of FIGS. 4 and 5 operate in a similar manner. A set of breaker points are positioned in a normally open orientation by ram 19. However, notch 46 defined in ram 19 initially permits points 45 to close, thereby energizing coil 47. Further travel of ram 19 again permits points 45 to open thereby collapsing the field around coil 47 and producing a high voltage which arcs across the gap of ignition device 26. As will be apparent to those skilled in the art, the embodiments of FIGS. 4 and 5 are essentially identical to the electrical circuits utilized to arc across the spark plug in internal combustion engines.

While switch 29 is shown in FIGS. 4 and 5 in the low-voltage portion of this circuit, any number of such switches may be provided in series; i.e., including switch 30 of FIGS. 2 and 3, to provide as many safety conditions as required to preclude inadvertent firing of the device.

A particularly preferred semi-automatic embodiment of driver 10 is illustrated in FIGS. 6 through 9. In common with the embodiment described in FIGS. 2 and 3 are pistons 17, cylinder 18, handle 14, ram 19, inlet port 22, reed check valve 23, ignition device 26 and exhaust ports 40.

Figures 6, 7, 8, 9, 10:
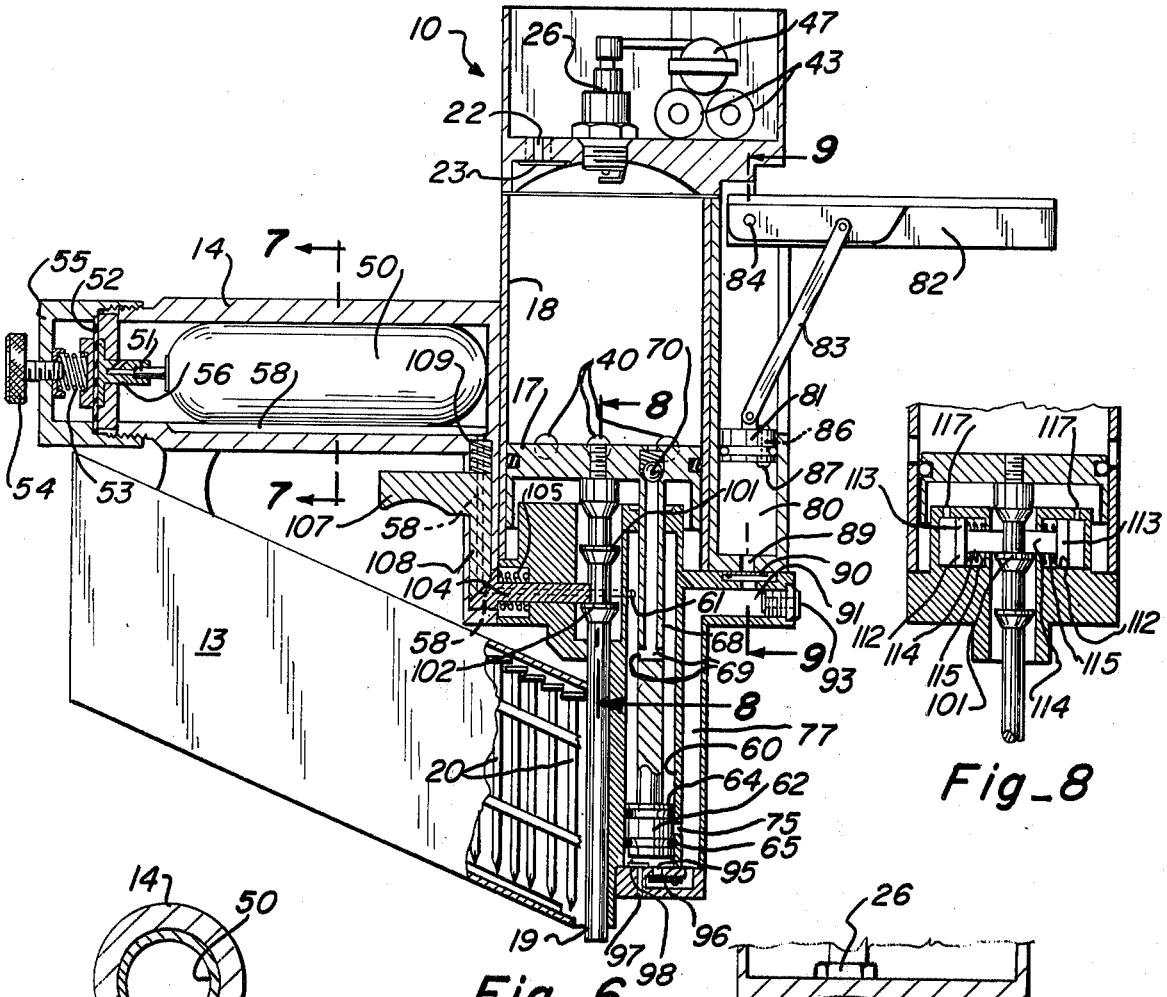
FIG. 6 is an illustration in section of a semi-automatic, nail-driving tool embodiment according to the instant invention.
FIG. 7 is a detailed sectional view along section line 7—7 shown in FIG. 6.
FIG. 8 is a detailed sectional view along section line 8—8 shown in FIG. 6.
FIG. 9 is a detailed sectional view along section line 9—9 shown in FIG. 6.
FIG. 10 is a partial view in section of an alternative embodiment of the device of FIG. 6.

With reference to FIG. 6, it will be seen that handle 14 encloses fuel tank 50 which is charged under pressure with a fuel which is liquified under pressure but gaseous at normal pressures. Pin 51, diaphram 52, spring 53 and threaded adjustment means 54 comprise an adjustable pressure regulator which permits gas to escape from fuel tank 50 as a result of pin 51 depressing a conventional valve on fuel tank until the force of the gas bearing on one side of diaphram 52 equals the force on the other side of diaphram 52 resulting from spring 53 bearing thereon. The preloading of spring 53 is determined by the position of threaded adjustment means 54 which is carried in threads in end cap 55. Accordingly, the entire volume carrying fuel tank 50 inside handle 14 is charged with the fuel at a predetermined pressure.

As a result of outlets 56 communicating at one end with the outlet of fuel tank 50 and at the other end with such volume, channel 58 is in communication with the gas under predetermined pressure at one end and with fixed volume return cylinder 60 by means of outlet 61 at the other end. FIG. 7 further illustrates the relationship of handle 14, fuel tank 50 and channel 58.

Return cylinder 60 will, as will be apparent, be charged with gaseous fuel under the predetermined pressure above return piston 62 in the configuration shown in FIG. 6. Return piston 62 is sealed by upper O-ring 64 and lower O-ring 65 and carried on partially hollow shaft 68. When return piston 62 is displaced upward, as will be described below, the gas in return cylinder 60 is displaced through cross-bore 69 into hollow shaft 68 and then past check valve 70 into cylinder 18. Since shaft 68 is integral with piston 17, upward displacement of return piston 62 also repositions piston 17 upward in cylinder 18. However, check valve 70 precludes flow from cylinder 18 into hollow shaft 68 as the gas above piston 17 is compressed.

A specific means for displacing return piston 62 upward is shown in FIGS. 6 and 9. Recharge port 75 is positioned between upper O-ring 64 and lower O-ring 65 on return piston 62 at the "ready" position thus producing no net axial force on return piston 62. Channel 77 interconnects recharge port 75 with high-pressure chamber 78 shown at FIG. 9.

Adjacent high-pressure chamber 78 is pump chamber 80 having a pump piston 81 dispose therein. Pump piston 81 is actuated by pump handle 82 which drives pump piston 81 through rod 83 and which is attached for movement at pivot 84. Accordingly, movement of pump handle 82 reciprocates pump piston 81 and, as pump piston 81 moves upward, permits air to pass through pump piston port 86. On the downstroke pump piston port 86 is sealed by pump piston check valve 87 thereby displacing air through pump chamber outlet 89 and past pump outlet check valve 90 into plenum 91. Plenum 91 is in communication with high-pressure chamber 78 and thus, through repeated reciprocation of pump piston 81, may be charged to a high pressure. A pressure release valve 93 is provided to manually bleed off pressure for storage and/or to automatically relieve destructive pressures. Also communicating with channel 77 is opening 95 defined in the bottom portion of return cylinder 60 and associated check valve 96.

Operation of impact tool 10 can be considered with regard to the fueling and recharge systems. Given the configuration shown in FIG. 6 with return cylinder 60 charged with a fixed volume of gas from fuel tank 50 under a predetermined pressure, and high-pressure chamber 78 containing air under substantial pressure, a force on ram 19 will displace piston 17 upward a small increment. Accordingly, shaft 68 connected to piston 17 will displace return piston 62 upward until lower O-ring 65 is positioned above recharge port 75. This permits high-pressure air from high-pressure chamber 78 to flow through plenum 91 into channel 77 and, through recharge port 75 into return cylinder 60. The high-pressure air in return cylinder 60 displaces return piston 62 upward and, in turn, displaces the combustible gas above return piston 62 through cross-bore 69 into hollow shaft 68 and ultimately past check valve 70 into cylinder 18. When piston 17 is displaced fully upward, or somewhat therebefore or thereafter, ignition device 26 is employed to ignite the compressed combustible fuel mixture utilizing batteries 43 and coil 47 in a manner discussed above and shown in more detail in FIG. 4. This drives piston 17 and associated ram downward to set nail 20 which moves in a conventional fashion from magazine 13 under ram 19 as ram 19 is displaced upward.

The upward movement of return piston 62 is facilitated by the passage of air through inlet 97 and past check valve 98. However, on the downward power stroke of piston 17 and attached return piston 62, check valve 98 closes inlet 97. The air under return piston 62 is displaced through opening 95 and past check valve 96 to recharge high-pressure chamber 78. On completion of the downward travel, piston 17 and ram 19 are arrested such that return piston 62 again is positioned with upper O-ring 64 above recharge port 75 and lower O-ring 65 below recharge port 75; i.e., in the "ready" position with a new charge of combustible gas above return piston 62 and high-pressure chamber 78 again recharged with high pressure air.

The downward positioning and securing of the movable assembly is accomplished by means shown in FIGS. 6 and 8. Ram 19 has defined thereon an upper shoulder 101 and lower shoulder 102. Lower shoulder 102 is engageable by pawl member 104. Pawl spring 105 urges pawl member 104 away from lower shoulder 102. Trigger 107 is connected to trigger rod 108 which interfaces with pawl member 104 and urges pawl member 104 towards lower shoulder 102. Trigger 107 is urged downward by trigger spring 109. Displacement upward of trigger rod 108 permits pawl spring 105 to displace pawl member 104 radially away from lower shoulder 102. Thus ram 19 is freed to move upward to initiate operation of the device as described above.

Upper shoulder 101 is employed, as shown in FIG. 8, to arrest and position ram 19 at an appropriate position at the end of the power stroke. Rebound cylinders 112 are defined on either side of ram 19 and carry rebound pistons 113 therein. Rebound bars 114 are displaceable by rebound pistons 113 to engage upper shoulder 101. However, rebound springs 115 normally bias rebound pistons 113 outward thereby disengaging rebound bars 114 from upper shoulder 101. When piston 17 moves downward during the power stroke, air trapped underneath piston 17 is displaced through ports 117 to urge rebound pistons 113 and rebound bars 114 to overcome rebound springs 115 and position rebound bars 114 in engagement with upper shoulder 101. Movement of ram 19 is thus terminated and ram 19 positioned with upper O-ring 64 and lower O-ring 65 appropriately positioned relative to recharge port 75. As the increased pressure below piston 17 bleeds away, rebound springs 115 retract rebound bars 114 from engagement with upper shoulder 101 thereby enabling the device to be actuated by displacement of trigger 107 and pawl member 104 in conjunction with an upward minor displacement of ram 19 by engagement with the work surface.

Still another embodiment of the invention is shown in FIG. 10. In this embodiment, the pressure recharge system is replaced with spring 120 which bears upon an enlargement 121 attached to shaft 68. Thus instead of compressing air as in the embodiment of FIG. 6, spring 120 is compressed to provide the recharge energy. A latch arrangement such as that employed with trigger 107 and lower shoulder 102 in FIG. 6 may be used to initiate the cycle.

The above description delineates various embodiments which employ compact bulk fuel sources for activation of impact tools. The preferred combustible gases are normally gaseous aslenes such as propane, butane or mixtures thereof. Liquified petroleum gases may also be employed to provide a high ratio of energy content to weight or volume.

Since these gases are clean burning, very little lubrication is required. However, a simple timed injection of oil and/or dry lubrication of the moving parts may be provided for extended wear life.

In addition to the normally gaseous fuels, normally liquid fuels such as gasoline may be utilized with a generator to atomize and vaporize the fuel. While the impact device has been described primarily with regard to a nailer, it is to be understood that a similar arrangement can be employed for various other impact tools. For instance, an impact wrench utilizing a smaller cylinder and piston than that required in a nailer and an automatic reciprocation means could be readily applied to rotating means conventionally used in such tools.

It is to be understood, of course, that numerous mechanical equivalents of the specific embodiments illustrated and discussed may be employed and will be readily apparent to those skilled in the art, given the concept of the apparatus and method of the instant invention. Accordingly, although only several specific embodiments of the instant invention have been illustrated and described, it is apparent that various changes and modifications will be evidenced to those skilled in the art and that such changes may be made without departing from the scope of the invention as defined by the following claims.

What is claimed is:

1. An impact tool comprising:

a cylinder fixedly closed at one end;

a piston movably positioned in the cylinder;

ram means depending from the piston away from the closed end of the cylinder;

ignition means positioned at the closed end of the cylinder;

means operably connected to the piston to inject a combustible gas from a bulk supply into the cylinder above the piston upon movement of the piston towards the closed end of the cylinder, a compressible medium confined within the tool;

means operatively connected to the piston for compressing the compressible medium upon movement of the piston away from the closed end of the cylinder;

means to releasably secure the piston and ram means against the force exerted by the compressed medium in a position with the piston spaced from the closed end of the cylinder, and;

means to position a nail below the ram means;

whereby, a combustible gas may be ignited by the ignition means to drive the piston and ram means away from the closed end of the cylinder thereby to drive a nail disposed below the ram means and to concurrently compress the compressible medium and engage the means to secure the piston in the spaced position away from the closed end of the cylinder, and thereafter, upon releasing the piston from the securing means, allowing the compressed medium to urge the piston towards the closed end of the cylinder while concurrently injecting the combustible gas into the cylinder above the piston and, when the piston reaches a position adjacent the closed end of the cylinder, again igniting the combustible gas to drive the piston, ram means and nail position under the ram means away from the closed end of the cylinder and again compress the compressible medium.

2. An impact tool as set forth in claim 1 in which the compressible medium is a spring.

3. An impact tool as set forth in claim 1 in which the means for compressing the compressible medium is a variable-volume chamber within the tool which chamber decreases in volume as the piston moves away from the closed end of the cylinder.

4. An impact tool as set forth in claim 3 which further includes manually operated pump means communicating with the variable-volume chamber, whereby a compressible gas may be pumped into the volume to initiate operation of the tool.

5. An impact tool as set forth in claim 3 which further comprises an orifice communicating with the variable-volume chamber, and closure means operably connected to the piston and ram means to close the orifice when the piston is spaced from the closed end of the cylinder.

6. An impact tool as set forth in claim 1 in which the means to releasably secure the piston ram means comprise a shoulder positioned on the ram means, a pawl movably positioned in the tool adjacent to and transverse to the ram means, pawl biasing means urging the pawl towards the ram means, and trigger means connected to the pawl, whereby the pawl will normally engage and secure the ram means as a result of being urged thereagainst by the pawl biasing means, but is releasable by the trigger means.

* * * * *